United States Patent [19]

Ranz et al.

[11] 4,369,248

[45] Jan. 18, 1983

[54] PHOTOGRAPHIC RECORDING MATERIAL AND ITS USE FOR THE PRODUCTION OF IMAGES

[75] Inventors: Erwin Ranz, Leverkusen; Heinz-Dieter Schütz, Bergisch Gladbach; Joachim W. Lohmann, Odenthal, all of Fed. Rep. of Germany

[73] Assignee: Agfa-Gevaert Aktiengesellschaft, Leverkusen, Fed. Rep. of Germany

[21] Appl. No.: 265,658

[22] Filed: May 20, 1981

[30] Foreign Application Priority Data

May 28, 1980 [DE] Fed. Rep. of Germany ..... 3020163

[51] Int. Cl.[3] ..... G03C 1/76

[52] U.S. Cl. ..... 430/376; 430/434; 430/495; 430/523; 430/539; 430/543; 430/551

[58] Field of Search ..... 430/434, 495, 496, 506, 430/523, 589, 543, 551, 607, 611, 613, 614, 615, 376

[56] References Cited

U.S. PATENT DOCUMENTS

| | | | |
|---|---|---|---|
| 3,152,907 | 10/1964 | Godowsky et al. | 430/365 |
| 3,640,719 | 2/1972 | Von König et al. | 430/614 |
| 3,761,278 | 9/1973 | Gauss et al. | 430/614 |
| 3,989,527 | 11/1976 | Locker | 430/395 |
| 4,130,428 | 12/1978 | Van Doorselaer | 430/139 |
| 4,186,016 | 1/1980 | Lohmann et al. | 430/506 |
| 4,229,525 | 10/1980 | Ueda | 430/569 |
| 4,267,264 | 5/1981 | Lohmann | 430/506 |
| 4,307,187 | 12/1981 | Ikenoue | 430/607 |

*Primary Examiner*—Mary F. Downey

*Attorney, Agent, or Firm*—Connolly and Hutz

[57] ABSTRACT

A photographic recording material contains in a silver halide layer an emulsion mixture of at least one light sensitive silver halide and a comparatively non-light sensitive silver salt and in a second layer, which is in waterpermeable arrangement, an antifogging agent or a precursor compound thereof.

10 Claims, No Drawings

PHOTOGRAPHIC RECORDING MATERIAL AND ITS USE FOR THE PRODUCTION OF IMAGES

This invention relates to a photographic recording material containing an emulsion mixture in one layer and an anti-fogging agent or a precursor compound for an anti-fogging agent in a separate layer. The invention also relates to the use of materials such as these for the production of images, in particular for the production of colour photographic images.

Standard light sensitive silver-halide-containing recording materials contain at least one layer of a silver halide emulsion the grains of which are light sensitive and contribute towards formation of the image after exposure and development.

A well-known problem in photographic chemistry is to obtain an optimal relation between the speed and fogging of a photographic emulsion. It has been found that speed increasing agents or measures frequently result in an increase in fogging. On the other hand, the use of fog-reducing stabilisers generally leads to a loss in speed. In other words, the photographic chemist finds himself in a real dilemma here.

Measures for preventing the fogging of photographic emulsions without affecting their photographic speed to any significant extent include the obtaining of optimal precipitation and ripening conditions, also the addition of certain stabilisers, such as tetraazaindene derivatives or heterocyclic mercapto compounds, some of which, in combination with certain sensitising dyes, may even produce an increase in speed. An alternative measure is to use so-called masked stabilisers which only release the actually effective stabilising compounds when the pH-value is increased, i.e. during photographic development, and in this way favourably influence development fogging.

It is clear that, in the search for increasingly more sensitive photographic recording materials, the expert will consider any measure which promises an increase in sensitivity without at the same time increasing fogging. Conversely, fogging can only be reduced by agents which have little or no effect upon speed. In colour photographic recording mterials, fogging appears in the form of a colour fog. In the case of negatively working recording materials, this colour fog increases the so-called copying density and, as a result, requires an increase in the intensity of exposure or an increase in the exposure time during the copying process. In the event of variations in the development parameters, for example the temperature and turbulence of the developer bath, fairly significant variations in fogging occur with naturally fairly high fog levels. It need not be mentioned that colour fog is totally undesirable in colour photographic reversal materials because of its adverse effect upon the white areas of the image.

It is known that fractions of a comparatively insensitive silver halide emulsion may be added to silver halide emulsion layers to improve their sensitometric properties, particularly their speed, as described in U.S. Pat. No. 3,152,907. It is known from U.S. Pat. No. 3,989,527 that spectrally sensitised emulsions may be mixed with emulsions which are not spectrally sensitized and which have a diameter of from 0.15 to 0.8$\mu$. British Pat. No. 1,342,687 describes emulsions which contain silver halide grains ranging from 0.3 to 3$\mu$ in size and less than 0.2$\mu$ in size in combination.

Although it is possible with materials such as these to obtain an increase in speed, an undesirable increase in photographic fogging is generally inevitable.

It is also known that anti-fogging agents may be added to emulsion mixtures, as described in U.S. Pat. Nos. 3,809,906 and 4,130,428. Although the addition of anti-fogging agents to the photosensitive layers of a photographic material reduces photographic fogging, it can at the same time depress speed which, basically, has been increased by the addition of a fine-grained emulsion.

One of the objects of the present invention is to provide an improved photographic material.

A photographic recording material has now been found which comprises a support layer, at least one silver halide emulsion layer I and at least one layer II which either contains no silver halide emulsion or which contains only a substantially non-light sensitive silver halide emulsion, at least one layer II (a) being in a water-permeable arrangement to the layer I and (b) containing an anti-fogging agent or a precursor compound for an anti-fogging agent.

The silver halide emulsion layer I contains an emulsion mixture of at least one light sensitive silver halide emulsion L and at least one fine-grained, comparatively insensitive silver salt emulsion U.

In a preferred embodiment, the mean grain size of the emulsion U is generally less than 0.5$\mu$. The mean grain size of the emulsion U is preferably between 0.01 and 0.5$\mu$, more preferably between 0.05 and 0.2$\mu$. The emulsion U is preferably a halide emulsion of which the halide fraction may consist of chloride, bromide or iodide or mixtures thereof. Bromide emulsions are preferably used. However, other silver salts may also be used for the emulsion U. The quantities of emulsion U, based on emulsion L, are in particular between 0.2 and 30 mole percent and preferably between 0.5 and 5 mole percent, based on silver.

The light sensitive silver halide emulsion L may consist of pure silver halides and of mixtures of different silver halides. For example, the silver halide grains of the emulsion L may consist of silver chloride, silver bromide, silver iodide, silver chlorobromide, silver chloroiodide, silver bromoiodide and silver chlorobromoiodide. In a preferred embodiment, the halide fraction of the emulsion L consists predominantly of bromide.

The layers I and II are in water-permeable relationship to one another. In the context of the invention, the expression "water-permeable relationship" is understood to mean that the layers are associated with one another in such a way that compounds diffusible from the layer II under the conditions of photographic development are capable of diffusing into the layer I. In a preferred embodiment, the layer II is directly adjacent to the layer I. In particular, it is preferred for the layer I to lie between the layer II and the support layer, optionally separated by further layers.

In principle, the anti-fogging agents used in accordance with the invention are not limited in regard to their structure. In general, it is preferred to use substances which may be incorporated in the layer II in substantially non-diffusing form, but which become diffusible in the alkaline medium of a photographic developer and may be absorbed on metallic silver and silver halide. Substances which are particularly suitable for this purpose are substances which are difficult to dissolve in water, but easy to dissolve in alkali. Particularly suitable substances are nitrogen-containing heterocyclic compounds, particularly with 5 or 6 ring members in the heterocyclic ring; further carbocyclic or heterocyclic rings may be fused to the heterocyclic ring. In a preferred embodiment, the anti-fogging agents used in accordance with the invention contain a mercapto group, although they may be present in the tautomeric form as thione. Particularly preferred anti-fogging agents include the above-mentioned nitrogen-containing heterocyclic compounds with 5 or 6 ring members in the heterocyclic ring, which contain a mercapto group and a carboxyl group.

Particularly preferred anti-fogging agents correspond to the following general formulae

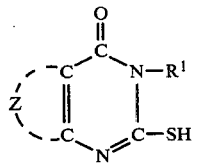

(1)

in which $R^1$ represents hydrogen, a saturated or olefinically unsaturated aliphatic group preferably containing up to 10 carbon atoms, which may be substituted or an aryl group, preferably a ring of the benzene series and Z represents the ring members required to complete a fused carbocyclic or heterocyclic 5-membered or 6-membered ring; preferred carbocyclic rings are those based on benzene; cyclopentene or cyclohexene; suitable fused heterocyclic rings include the following: pyridine; tetrahydropyridine; pyrimidine; pyrrole; furan; thiophene; oxazole; isooxazole; thiazole; imidazole; pyrazole or 1,2,3-triazole; the fused carbocyclic or heterocyclic ring may contain further substituents, for example saturated or olefinically unsaturated aliphatic groups containing from 1 to 18 carbon atoms and preferably up to 5 carbon atoms; phenyl; halogen, such as chlorine or bromine, hydroxy or alkoxy; either the fused carbocyclic or heterocyclic ring or an aliphatic or aromatic group on that ring or the substituent $R^1$ contains at least one carboxyl group.

The compounds set out in Table 1 below have proved to be particularly suitable:

TABLE 1

| Compound | |
|---|---|
| 1.1 | 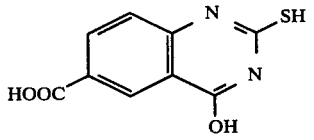 |
| 1.2 | 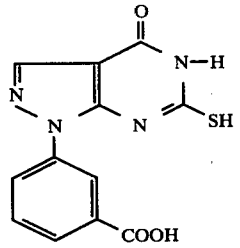 |

TABLE 1-continued

| Compound | |
|---|---|
| 1.3 | 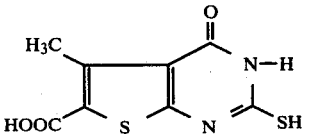 |
| 1.4 | 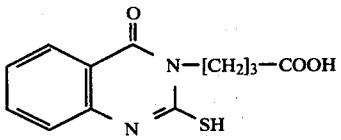 |
| 1.5 | 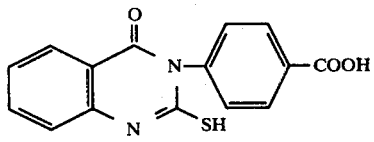 |
| 1.6 | 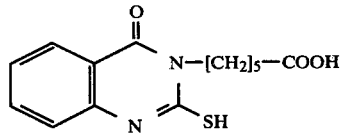 |
| 1.7 | 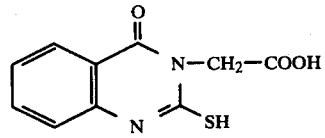 |
| 1.8 | 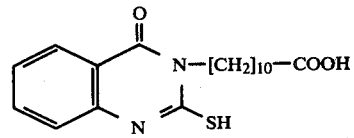 |

The compounds used in accordance with the invention may be obtained by methods known in principle, such as those described in U.S. Pat. No. 3,859,095, and may be present in tautomeric form.

Instead of, or in addition to, the anti-fogging agents used in accordance with the invention, it is also possible to use precursor compounds for anti-fogging agents. Precursor compounds are understood to be compounds which, under the conditions of photographic processing, particularly development, release substances which reduce photographic fogging. The compounds released correspond to the above-mentioned anti-fogging agents used in accordance with the invention. Preferred precursor compounds correspond to general formula 1a below:

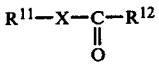

1a in which $R^{11}$ represents a heterocyclic ring which may be substituted, particularly a 5- or 6-membered N-containing ring which may be substituted and to which further rings, particularly aromatic rings, may be fused; phenyl, naphthyl, pyrimidine are particularly suitable;

X represents a sulphur atom or a single chemical bond to the nitrogen atom of a heterocyclic ring;

$R^{12}$ represents alkyl, particularly containing from 1 to 6 carbon atoms, aryl, particularly phenyl, alkoxy, particularly containing from 1 to 6 carbon atoms, aroxy, particularly phenoxy, cycloalkoxy, particularly cyclohexyloxy, the radical —X—$R^{11}$, the radical —$[CH_2]_n$—CO—X—$R^{11}$; n is an integer, particularly from 1 to 6;

$R^{11}$ represents in particular a benzimidazolin-2-thione, imidazole, oxazole, thiazole, oxidazole, thiaziazole, triazole, benzoxazole, benzimidazole, benzthiazole, pyrimidine, tetrazole, quinoline, naphthoxazole, purine, triazine or s-triazolo[4,3-a]quinoline which may be substituted.

Particularly preferred substituents for $R^{11}$ are aryl, particularly phenyl; carboxylamino which may be esterified; alkylamino, particularly methylamino; acylamino, particularly acetylamino; alkylmercapto, particularly methylmercapto; ureido, particularly alkylureido and alkyl, particularly containing from 1 to 4 carbon atoms.

The substituents $R^{12}$ may in turn be substituted, particularly by alkyl, for example, containing from 1 to 4 carbon atoms.

Typical compounds of this type are described in U.S. Pat. Nos. 3,311,474; 3,364,028; 3,365,294; 3,615,617; 3,640,719 and 3,761,278 and British Pat. No. 1,186,441.

Particularly suitable precursor compounds correspond to formulae 2 to 5 below:

(2)

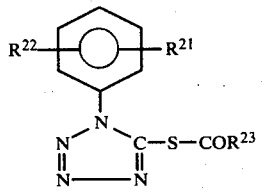

(3)

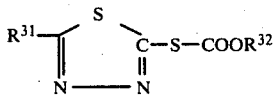

(4)

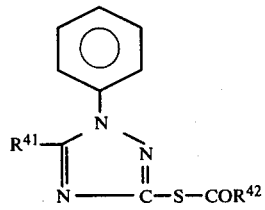

(5)

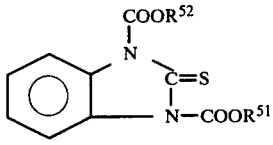

in which $R^{21}$ and $R^{22}$ which may be the same or different, represent hydrogen, alkyl containing from 1 to 4 carbon atoms or halogen, particularly chlorine;

$R^{21}$ and $R^{22}$ being in particular in the 3-position and 4-position respectively;

$R^{23}$ represents aryl, particularly phenyl; cycloalkoxy, particularly cyclohexyloxy; alkoxy, particularly containing from 1 to 4 carbon atoms, or the group

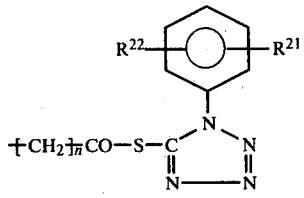

n is an integer of from 1 to 6;

$R^{31}$ represents alkyl mercapto, particularly methyl mercapto; alkylamino, particularly methylamino; acylamino, particularly acetylamino; esterified carboxylamino, particularly ethyl- and p-alkylcyclohexyloxycarbonylamino; or alkylureido, particularly containing from 2 to 5 carbon atoms;

$R^{32}$ represents alkyl which may be substituted, particularly containing from 1 to 4 carbon atoms; or cycloalkyl which may be substituted; particularly cyclohexyl, especially alkyl-substituted cyclohexyl;

$R^{41}$ represents hydrogen or acylamino, particularly acetylamino;

$R^{42}$ represents alkoxy, particularly containing from 1 to 4 carbon atoms, or the radical

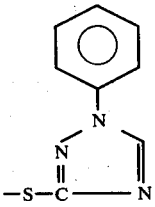

$R^{51}$ and $R^{52}$ may be the same or different and represent alkyl, particularly containing from 1 to 4 carbon atoms.

Particularly suitable compounds are shown in Tables 2 to 5 below.

TABLE 2

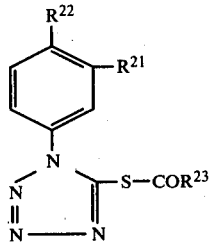

| No. | $R^{21} = R^{22}$ | $R^{23}$ |
|---|---|---|
| 2.1 | H | $OC_4H_9$—n |
| 2.2 | H | 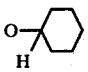 |
| 2.3 | H | 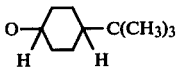 |
| 2.4 | Cl | $OC_4H_9$—n |
| 2.5 | Cl | 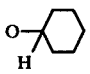 |

TABLE 2-continued

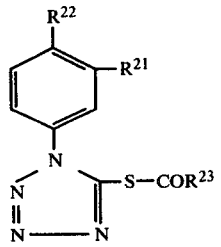

| No. | $R^{21} = R^{22}$ | $R^{23}$ |
|---|---|---|
| 2.6 | Cl | 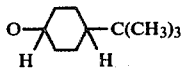 |
| 2.7 | Cl | 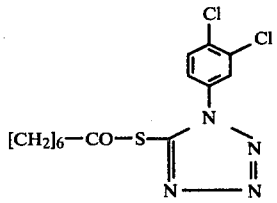 |
| 2.8 | Cl | 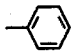 |

TABLE 3

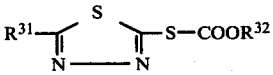

| No. | $R^{31}$ | $R^{32}$ |
|---|---|---|
| 3.1 | $NH-COOC_2H_5$ | $C_2H_5$ |
| 3.2 | 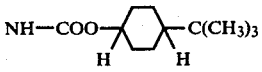 | 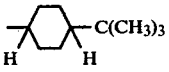 |
| 3.3 | $NH-CH_3$ | $C_4H_9-n$ |
| 3.4 | $NH-CH_3$ | 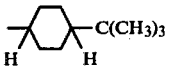 |
| 3.5 | $NH-COCH_3$ | 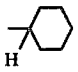 |
| 3.6 | $SCH_3$ | $C_4H_9-n$ |
| 3.7 | $SCH_3$ | 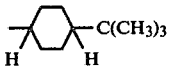 |
| 3.8 | $NH-CO-NH-C_4H_9-n$ | $C_4H_9-n$ |
| 3.9 | $NH-COOC_4H_9-n$ | $C_4H_9-n$ |

TABLE 4

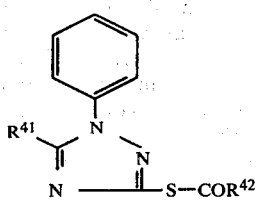

| No. | $R^{41}$ | $R^{42}$ |
|---|---|---|
| 4.1 | $NH-COCH_3$ | $OC_4H_9-n$ |
| 4.2 | $NH-COCH_3$ | $OC_2H_5$ |
| 4.3 | H | 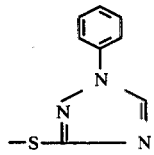 |

TABLE 5

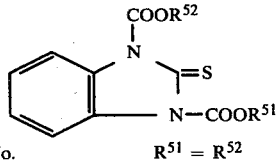

| No. | $R^{51} = R^{52}$ |
|---|---|
| 5.1 | $C_2H_5$ |
| 5.2 | $CH_2-CH_2-CH_3$ |
| 5.3 | $CH(CH_3)_2$ |

It has surprisingly been found that the anti-fogging agents or precursor compounds used in accordance with the invention, which are arranged relative to a sensitive silver halide emulsion layer in the manner according to the invention, reduce the photographic fogging produced by the addition of emulsion U without any noticeable reduction in speed. Accordingly, the speed/fogging relationship is significantly improved in accordance with the invention. The arrangement according to the invention may be used in any layer assemblies, for example in assemblies having a so-called normal layer sequence (N) and also in assemblies having a so-called alternating layer sequence (A). The layer assembly N is described in the following as an example of a layer assembly having a normal layer sequence:

The following layers are applied in the order indicated to a support layer:

| Layer assembly N | Layer |
|---|---|
| A | relatively low-speed cyan layer |
| B | relatively high-speed cyan layer |
| C | gelatin-containing protective layer |
| D | relatively low-speed magenta layer |
| E | relatively high-speed magenta layer |
| F | gelatin-containing protective layer |
| G | yellow filter layer |
| H | relatively low-speed yellow layer |
| I | relatively high-speed yellow layer |
| K | protective layer |

The following layer assembly A is mentioned as an example of an alternating layer assembly. In this case, the following layers are applied in the order indicated to a support layer:

| Layer assembly A | Layer |
|---|---|
| A | relatively low-speed cyan layer |
| B | gelatin-containing protective layer |
| C | relatively low-speed magenta layer |
| D | gelatin-containing protective layer |
| E | relatively high-speed cyan layer |
| F | gelatin-containing protective layer |
| G | relatively high-speed magenta layer |
| H | gelatin-containing protective layer |
| I | yellow filter layer |
| K | relatively low-speed yellow layer |
| L | relatively high-speed yellow layer |
| M | protective layer |

According to the invention, the layer assemblies I and II illustrated may be incorporated at the following points:

| Layer assembly | Emulsion U in layer | Antifogging agent in layer |
|---|---|---|
| N | B | C |
| N | E | F |
| N | I | K |
| A | E | F |
| A | G | H |
| A | L | M |

The measures referred to may be applied either individually or in combination in the layer assemblies in order to control the speed of the component colour layers.

Other advantageous layer assemblies are those in which a component colour pack consists not of two coupling component layers, but instead of three or more component layers which couple to form identical colours or in which other alternating layer sequences than indicated in layer assembly A occur.

It has also been found that the materials according to the invention may be used with advantage for the production of photographic images by exposure and development. In particular, it is of advantage to select the development conditions in such a way that physical development is possible to at least a certain extent. In particular, the materials are also suitable for development at a temperature above 30° C.

The materials according to the invention are preferably colour photographic recording materials.

The colour photographic recording materials normally contain a silver halide emulsion layer unit for recording light of each of the three regions of the spectrum, namely red, green and blue. To this end, the light sensitive layers are spectrally sensitised in known manner by suitable sensitising dyes. The blue-sensitive silver halide emulsion layer unit does not necessarily have to contain a spectral sensitiser because, in many cases, the natural sensitivity of the silver halide is sufficient for recording blue light.

Each of the above-mentioned silver halide emulsion layer units may contain a single silver halide emulsion layer or, in known manner, for example in the so-called double layer arrangement, two or even more silver halide emulsion layers as described in German Pat. No. 1,121,470. The red-sensitive silver halide emulsion layer unit is normally arranged nearer to the support layer than the green-sensitive silver halide emulsion layer unit which in turn is arranged nearer to the support layer than the blue-sensitive silver halide emulsion layer unit, a non-light sensitive yellow filter layer generally being arranged between the green-sensitive and blue-sensitive layers. However, other arrangements are also possible. In general, a non-photosensitive intermediate layer which may contain means for suppressing the undesirable diffusion of developer oxidation products is generally arranged between layers of different spectral sensitivity. Where a silver halide emulsion layer unit contains several silver halide emulsion layers having the same spectral sensitivity, these layers may be arranged immediately adjacent to one another or is such a way that one or more light sensitive layers of different spectral sensitivity is situated between them as described in U.S. Pat. Nos. 3,726,821, 4,184,876; 4,129,446 and 4,186,016.

The non-diffusing dye components associated with the photosensitive silver halide emulsion layer units may, in principle, by any type of non-diffusing compounds from which image dyes having the required spectral and sensitometric properties may be produced by suitable treatment (development). For example, the compounds in question may be so-called dye-producing compounds which are incorporated in non-diffusing form in the layers and from which diffusing image dyes are released during photographic development and may be transferred to an image-receiving layer. However, a non-diffusing colour coupler capable of reacting with colour developer oxidation products to form a non-diffusing dye is preferably associated with each of the above-mentioned photosensitive silver halide emulsion layers. The non-diffusing colour couplers are preferably located in the light sensitive layer itself or in close proximity thereto.

The colour couplers which may be associated with the two or more component layers of the same spectral sensitivity do not necessarily have to be the same. They are merely required during colour development to produce the same colour, normally a colour which is complementary to the colour of the light to which the photosensitive silver halide emulsion layers are sensitive. Accordingly, at least one non-diffusing colour coupler for producing the cyan component colour image, generally a coupler of the phenol or $\alpha$-naphthol type, is associated with the red-sensitive silver halide emulsion layers. The green-sensitive silver halide emulsion layers each contain at least one non-diffusing colour coupler for producing the magenta component colour image, colour couplers of the 5-pyrazolone or indazolone type normally being used. Finally, the blue-sensitive silver halide emulsion layers each contain at least one non-diffusing colour coupler for producing the yellow component colour image, generally a colour coupler containing an open-chain ketomethylene group. Large numbers of colour couplers of these types are known and are described in many Patent Specifications. Reference is made here for example to the publications "Farbkuppler (Colour Couplers)" by W. Pelz in "Mitteilungen aus den Forschungs-laboratorien der Agfa, Leverkusen/-Munchen", Vol. III, page 111 (1961) and K. Venkataraman in "The Chemistry of Synthetic Dyes", Vol. 4, 341 to 387, Academic Press (1971).

The colour couplers may be both standard 4-equivalent couplers and also 2-equivalent couplers in whose case a smaller quantity of silver halide is required for dye production. It is known that 2-equivalent couplers derive from the 4-equivalent couplers in that, in the coupling position, they contain a substituent which is split off during the coupling reaction. 2-equivalent couplers which may be used in accordance with the invention include both those which are substantially colourless and also those which have a strong natural colour which disappears during the colour coupling reaction or is replaced by the colour of the image dye produced. According to the invention, the latter couplers may also additionally be present in the light sensitive silver halide emulsion layers where they serve as masking couplers to compensate for the unwanted secondary densities of the image dyes. The 2-equivalent couplers also include the known white couplers, although they do not release any dye on reaction with colour developer oxidation products. The 2-equivalent couplers also include the known DIR-couplers which are couplers containing in the coupling position a reasonable radical which is released as a diffusing development inhibitor on reaction with colour developer oxidation products.

If required, it is possible to use colour coupler mixtures to obtain a particular colour or a particular reactivity. For example, water-soluble couplers may be used in combination with hydrophobic water-insoluble couplers.

The silver halide emulsions may be produced both by the single inflow process and also by the double inflow process. Suitable processes of this type are described for example in British Pat. No. 1,027,146 and in the article by E. Moisar and S. Wagner in "Berichte der Bunsengesellschaft fur physikalische Chemie", 67 (1963), pages 356 to 359. It is also possible to produce relatively coarse-grained emulsions by dissolving fine-grained starting emulsions and allowing them to crystallise in the presence of silver complex formers and in the presence of the peptising agents according to the invention. Processes such as these are known for example from U.S. Pat. Nos. 2,146,938; 3,206,313 and 3,317,322 and German Auslegeschrift No. 1,207,791.

According to the invention, it is possible to precipitate emulsions with both a narrow and also with a relatively wide grain size distribution. In particular, it is possible in accordance with the invention to produce both homodisperse and heterodisperse silver halide emulsions.

Homodisperse emulsions are understood to be emulsions having a narrow grain size distribution. In their case, at least 95% of the silver halide grains preferably have a diameter which deviates by no more than 40% or preferably by no more than 20% from the mean grain diameter. The silver halide grains may have any of the known forms, for example cubic, octahedral or even a mixed tetra/decahedral form.

Heterodisperse emulsions are understood in particular to be emulsions in which at least 10% but preferably at least 20% of the silver halide grains have a diameter which deviates by at least 20% from the mean grain diameter. The silver halide grains of emulsions such as these generally have an irregular form.

To remove the water-soluble salts, the silver halide emulsions may either be hardened, noodled and rinsed in known manner following the addition of gelatin or may even be coagulated with a coagulating agent and subsequently washed, as known for example from German Offenlegungsschrift No. 2,614,862.

The photographic materials may be developed with standard colour developer substances, for example N,N-dimethyl-p-phenylene diamine; 4-amino-3-methyl-N-ethyl-N-methoxy ethyl aniline; 2-amino-5-diethylaminotoluene; N-butyl-N-$\omega$-sulphobutyl-p-phenylene diamine; 2-amino-5-(n-ethyl-N-$\beta$-methane-sulphonamidoethylamino)-toluene; N-ethyl-N-$\beta$-hydroxy ethyl-p-phenylene diamine; N,N-bis-($\beta$-hydroxyethyl)-p-phenylene diamine and 2-amino-5-(N-ethyl-N-$\beta$-hydroxyethylamino)-toluene. Other suitable colour developers are described, for example, in J. Amer., Chem. Soc. 73, 3100 (1951).

Gelatin is preferably used as binder for the photographic layers. However, it may be completely or partly replaced by other natural or synthetic binders.

The emulsions, particularly of the L type, may also be chemically sensitised, for example by the additiion during chemical ripening of sulphur-containing compounds, for example allyl isothiocyanate, allyl thiourea and sodium thiosulphate. Other suitable chemical sensitisers are reducing agents, for example the tin compounds described in Belgian Pat. Nos. 493,464 or 568,687, also polyamines, such as diethylene triamine or aminomethyl sulphinic acid derivatives, for example according to Belgian Pat. No. 547,323. Other suitable chemical sensitisers are noble metals and noble metal compounds, such as gold, platinum, palladium, iridium, ruthenium or rhodium. It is also possible to sensitise the emulsions with polyalkylene oxide derivatives, for example with polyethylene oxide having a molecular weight in the range from 1000 to 20,000, and also with condensation products of alkylene oxides and alcohols, aliphatic carboxylic acids, aliphatic amines, aliphatic diamines and amides.

The emulsions, particularly of the L type, may even be optically sensitised, for example with the usual polymethine dyes, such as neutrocyanines, basic or acid carbocyanines, rhodacyanines, hemicyanines styryl dyes, oxonols and the like. Sensitisers such as these are described in F. M. Hamer's book entitled "The Cyanine Dyes and Related Compounds", (1964).

The optical sensitiser may be added to the layers containing the emulsions L and U in particular as follows:

(a) addition to the mixture of emulsions L and U;
(b) addition to the individual emulsions L and U, followed by mixing;
(c) addition only to emulsion L, followed by mixing with the non-sensitised emulsion U.

The emulsions may additionally contain the usual stabilisers such as, for example, homopolar or salt-like compounds of mercury with aromatic or heterocyclic rings, such as mercapto triazoles, single mercury salts, sulphonium-mercury double salts and other mercury compounds. Other suitable stabilisers are azaindenes, preferably tetra- or penta-azaindenes, particularly those substituted by hydroxyl or amino groups. Compounds such as these are described for example in the article by Birr in Z. Wiss. Phot. 47 (1952), 2 to 58. Other suitable stabilisers are inter alia heterocyclic mercapto compounds, for example phenyl mercaptotetrazole, quaternary benzthiazole derivatives and benzotriazole.

The layers of the photographic material may be hardened in the usual way, for example with formaldehyde or halogen-substituted aldehydes containing a carboxyl group, such as mucobromic acid, diketones, methane sulphonic acid esters, dialdehydes and the like. The photographic layers may also be hardened with epoxide, heterocyclic ethylene imine or even acryloyl hardeners. It is also possible to harden the layers by the process according to German Offenlegungsschrift No. 2,218,009 to obtain colour photographic materials which are suitable for processing at high temperatures. The photographic layers or the colour photographic multilayer materials may also be hardened with diazine, triazine or 1,2-dihydroquinoline hardeners. Examples of hardeners such as these are diazine derivatives containing alkyl or aryl sulphonyl groups, derivatives of hydrogenated diazines or triazines such as, for example, 1,3,5-hexahydrotriazine, fluorine-substituted diazine derivatives such as, for example, fluoropyrimidine, esters of disubstituted 1,2-dihydroquinoline or 1,2-dihydroisoquinoline-N-carboxylic acids. Other suitable hardeners are vinyl sulphonic acid hardeners, carbodiimide or carbamoyl hardeners of the type described, for example, in German Offenlegungsschrifts Nos. 2,263,602; 2,225,230 and 1,808,685; French Pat. No. 1,491,807; German Pat. No. 872,153 and East German Pat. No. 7218. Other suitable hardeners are described for example in British Pat. No. 1,268,550.

The anti-fogging agents or precursor compounds used in accordance with the invention may be used in solution, emulsified in oil formers or ground as oil-former-free dispersed products. The quantity of anti-fogging agents or precursor compounds used is preferably from 0.005 to 0.50% by weight and more particularly from 0.01 to 0.20% by weight, based on the sum of the quantities of silver nitrate in emulsion U and emulsion L. The layer II containing the anti-fogging agents or precursor compounds may additionally contain further components, for example colour couplers in dissolved, dispersed or emulsified form, or wetting agents, plasticisers etc.

EXAMPLE 1

To illustrate the invention, the layer assembly described below is taken as the starting point. The layers mentioned are applied in the order indicated to a transparent support layer. The quantities quoted are each based on 1 square meter. So far as the silver coating is concerned, the corresponding quantities of silver nitrate are given.

1. A relatively low-speed red-sensitive layer containing a red-sensitised silver bromo iodide emulsion (5 mole percent of AgI) of 3.0 g of $AgNO_3$ containing 790 mg of a cyan coupler corresponding to the following formula

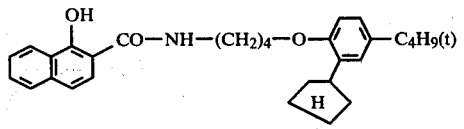

25 mg of a DIR-coupler corresponding to the following formula

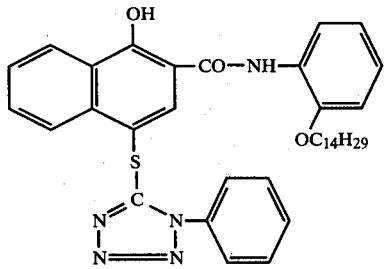

and 1.6 g of gelatin.

2. An intermediate layer of 0.7 g of gelatin.

3. A relative low-speed green-sensitive layer containing a green-sensitised mixture of a relatively sensitive silver bromo iodide emulsion (5 mole percent of AgI) of 1.5 g of $AgNO_3$ and a relatively low-speed silver bromo iodide emulsion of 1.9 g of $AgNO_3$ containing 600 mg of a magenta coupler corresponding to the following formula

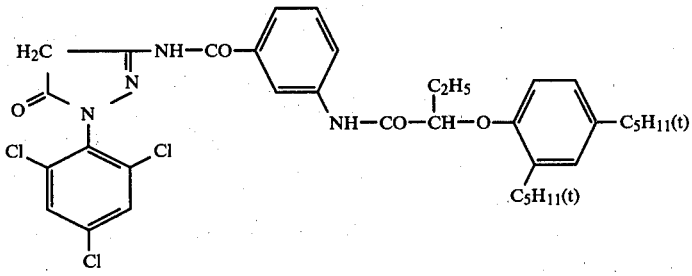

60 mg of a DIR-coupler corresponding to the following formula

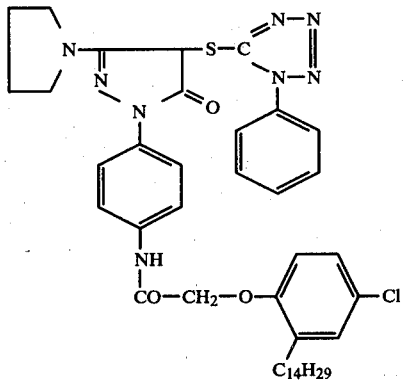

80 mg of a masking coupler corresponding to the following formula

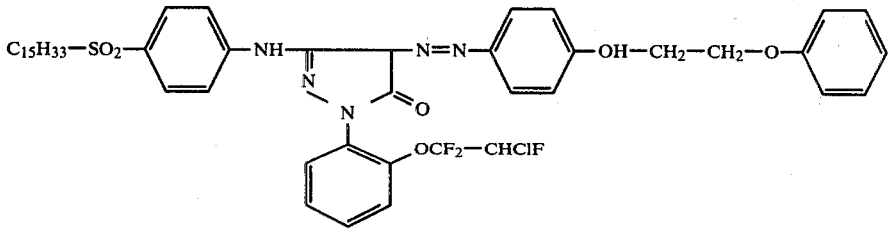

and 2.0 g of gelatin.

4. An intermediate layer containing 0.7 g of gelatin.

5. A high-speed red-sensitive layer containing a red-sensitive silver bromo iodide emulsion (5 mole percent of AgI) of 2.0 g of $AgNO_3$ containing 250 mg of the cyan coupler of layer 1 and 1.0 g of gelatin.

6. An intermediate layer containing 0.7 g of gelatin, very fine-grained silver chloride (mean grain size <0.1 μm) of 0.34 g of $AgNO_3$ and 76 mg of a DIR-coupler corresponding to the following formula

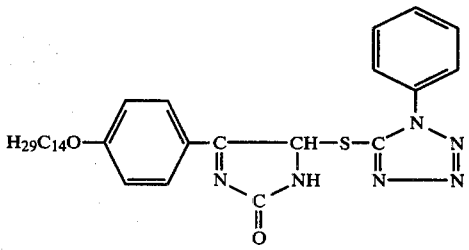

7. A high-speed green-sensitive layer containing a green-sensitised silver bromo iodide emulsion (7 mole percent of AgI) of 2.6 g of $AgNO_3$ containing 170 mg of a magenta coupler corresponding to the following formula

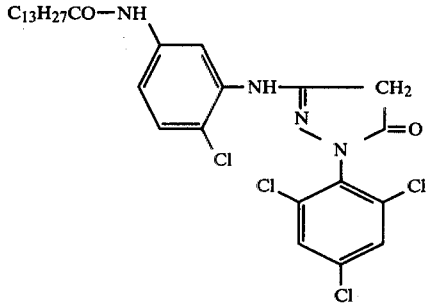

37 mg of a magenta coupler corresponding to the following formula

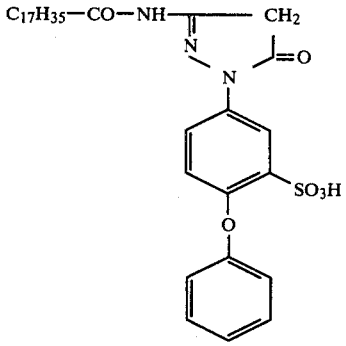

and 2.1 g of gelatin.

8. An intermediate layer containing 0.7 g of gelatin.

9. A yellow filter layer containing colloidal silver for producing a yellow density of 0.8.

10. A relatively low-speed blue-sensitive layer containing a mixture of a low-speed silver bromo iodide emulsion (5 mole percent of AgI) of 0.5 g of $AgNO_3$ and a relatively low-speed silver bromo iodide emulsion (3 mole percent of AgI) of 0.5 g of $AgNO_3$ containing 1.0 g of a yellow coupler corresponding to the following formula

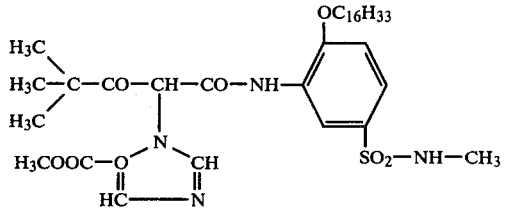

and 2 g of gelatin.

11. A high-speed blue-sensitive layer containing a relatively high-bromo iodide emulsion (6 mole percent of AgI) of 1.75 g of $AgNO_3$ containing 0.6 g of a yellow coupler corresponding to the following formula

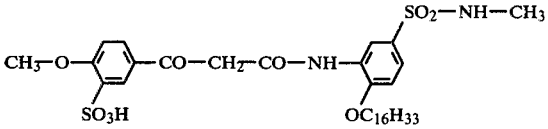

and 2.0 g of gelatin, and optionally the additives indicated in Table 3. A pure AgBr-emulsion was used as the micrate emulsion.

12. A surface layer of 0.9 g of gelatin and, optionally, the additives indicated in Table 3.

The compounds indicated in Table 6 are used in the following as examples of anti-fogging agents suitable for use in accordance with the invention.

Development is carried out in a high-temperature processing step as described in "The British Journal of Photography", 12, pages 597 and 598 (1974). In the following Examples, speed is expressed in relative units, as measured at 0.2 density units over the fog. Doubling of the value corresponds to doubling of the speed.

$\gamma_1$ is the gradation section of the characteristic curve which passes from the photosensitivity point (D=0.2 over fog) to an exposure value higher than 0.8 log I.t-units. The section extending from this end point to an exposure value higher by another 0.8 log I.t-units is denoted $\gamma_2$.

The sensitometric results are shown in Table 6. The yellow densities quoted in Table 6 are the "photographic fogs" formed during development in the yellow layers 10 and 11 in which the "constant yellow fogs" from other layers, such as for example from yellow masks, from the support layer etc., are not present. This "photographic yellow fog" is obtained by substracting the fog density of a non-developed, but bleached and fixed, sample from the fog density of a sample which has been subjected to the entire processing step.

In order the illustrate the surprising advance obtainable in accordance with the invention, the layer assembly described above was varied as follows. In two test series A and B carried out separately from one another, the additions indicated in Table 3 were made to the relatively high-speed blue-sensitive layer (layer 11) and the overlying surface layer (layer 12). The compound 1.1 used in accordance with the invention was added together with a micrate emulsion having a mean grain size of 0.05$\mu$ as the fine-grained, comparatively non-sensitive silver salt emulsion U. The micrate emulsion was prepared in known manner in accordance with W. Markocki, Korpuskularphotographie IV, 1963, page 165, with the modification that no $Cd(NO_3)_2$ was used.

Compounds 1.2, 1.3, 1.4, 1.5, 1.7, 1.8, 1.6 give comparable results when used in molar quantities comparable with those of compound 1.1.

Explanation of Table 6:

$\alpha$: quotient of yellow sensitivity and yellow fog density

Table 6 shows that, compared with the comparison sample A/1, which contains neither a micrate emulsion in layer 11 nor an anti-fogging agent in layer 12, speed is increased by the addition of a micrate emulsion alone, although fogging rises to an unacceptable level (test No. A/2). It has also been found that, although the addition of an anti-fogging agent alone to layer 12 (test No. A/3) suppresses fogging, no improvement is as expected obtained in speed. By contrast, the simultaneous addition of the micrate emulsion in layer 11 and the anti-fogging agent in layer 12 (test No. A/4) surprisingly produces a significant increase in speed without any increase in fogging over the comparison sample.

Test B/2 to B/5 according to the invention show how the speed/fogging relation can be varied in accordance with the invention by adding different quantities of micrate emulsion for the same quantity of anti-fogging agent.

Accordingly, the advance obtained in accordance with the invention is all the more surprising insofar as the simultaneous addition of the micrate emulsion and the anti-fogging agent in layer 11 (test No. B/6) does not produce any improvement over comparison sample B/1.

EXAMPLE 2

The layer assembly according to test No. A/1 described in Example 1 is modified in accordance with the invention by the addition of a precursor compound for an anti-fogging agent, as indicated in Table 7, to layer 12 and of a micrate emulsion to layer 11. Compound 2.1 is introduced in the form of a 1% solution in acetone. The quantities added and the sensitometric results are shown in Table 7 below. Processing and definition of the sensitometric values correspond to Example 1.

TABLE 6

| | | Layer 11 | | | | | |
|---|---|---|---|---|---|---|---|
| Test No. | Layer 12 compound 1.1 mg/m$^2$ | emulsion emulsion mg of $AgNO_3$/m$^2$ | compound 1.1 mg/m$^2$ | Yellow speed | Yellow fog density | Yellow gradation $\gamma_1/\gamma_2$ | $\alpha$ |
| Test series A | | | | | | | |
| A/1 | — | — | — | 1.00 | 0.17 | 0.80/0.76 | 5.88 |
| A/2 | — | 300 | — | 1.55 | 0.24 | 0.79/0.74 | 6.46 |
| A/3 | 1.0 | — | — | 0.97 | 0.11 | 0.82/0.75 | 8.82 |
| A/4 (invention) | 1.0 | 300 | — | 1.51 | 0.17 | 0.84/0.72 | 8.89 |
| Test series B | | | | | | | |
| B/1 | 0.6 | — | — | 1.00 | 0.13 | 0.79/0.78 | 7.69 |
| B/2 (invention) | 0.6 | 40 | — | 1.15 | 0.14 | 0.80/0.74 | 8.20 |
| B/3 (invention) | 0.6 | 80 | — | 1.48 | 0.15 | 0.80/0.74 | 9.87 |
| B/4 (invention) | 0.6 | 160 | — | 1.78 | 0.16 | 0.81/0.75 | 11.13 |
| B/5 (invention) | 0.6 | 320 | — | 2.00 | 0.18 | 0.83/0.75 | 11.11 |
| B/6 | — | 160 | 0.6 | 1.02 | 0.14 | 0.81/0.77 | 7.20 |

TABLE 7

| Test No. | 12 Layer 12 compound 2.1 mg/m² | Layer 11 micrate emulsion mg of AgNO/3m² | compound 2.1 mg/m² | Yellow speed | Yellow fog density | Yellow gradation $\gamma_1/\gamma_2$ | α |
|---|---|---|---|---|---|---|---|
| A/1 | — | — | — | 1.00 | 0.17 | 0.80/0.76 | 5.88 |
| C/1 (invention) | 2.0 | 300 | — | 1.48 | 0.15 | 0.82/0.73 | 9.87 |

Compounds 2.1 to 2.8, 3.1 to 3.9, 4.1 to 4.3 and 5.1 to 5.3 produce comparable results when used in molar quantities comparable to those of compound 2.1.

It follows from Table 7 that, even where a precursor compound is used, a surprising improvement is obtained in the speed/fogging relation.

We claim:

1. A photographic recording material comprising a support layer, at least one silver halide emulsion layer I, which contains an emulsion mixture of at least one light sensitive silver halide emulsion layer L and a fine-grained, comparatively non-light sensitive silver halide emulsion U, and at least one layer II which either contains no silver halide emulsion or only a comparatively non-sensitive silver halide emulsion, and wherein the combination includes improvement comprises at least one layer II (a) is in water-permeable arrangement in relation to at least one layer I and (b) contains an anti-fogging agent or a precursor compound for an anti-fogging agent.

2. A material as claimed in claim 1, wherein the improvement comprises the emulsion U is essentially a silver bromide emulsion and wherein the mean grain diameter of the non-sensitive emulsion U is smaller than 0.5 μm.

3. A material as claimed in claim 1, wherein the improvement comprises layer I is arranged closer to the support layer than layer II.

4. A material as claimed in claim 1, wherein the improvement comprises layer II does not contain any silver salt.

5. A material as claimed in claim 1, wherein the improvement comprises a color coupler or a dye-producing compound is present.

6. A material as claimed in claim 1, wherein the improvement comprises the anti-fogging agent corresponds to the following general formula:

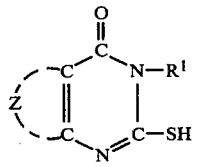

(1)

in which $R^1$ represents hydrogen, a saturated or olefinically unsaturated aliphatic group or aryl;

Z represents the ring members required to complete a fused carbocyclic or heterocyclic 5-membered or 6-membered ring, the fused ring being able to contain further substituents with the proviso that either the fused ring or an aliphatic or aromatic group on this ring or the substituent $R^1$ contains at least one carboxyl group.

7. A material as claimed in claim 1, wherein the improvement comprises the precursor compound may be incorporated in photographic materials in non-diffusing form and releases a diffusible anti-fogging agent under the conditions of photographic development.

8. A material as claimed in claim 7, wherein the improvement comprises the precursor compound corresponds to the following general formula:

$$R^{11}-X-\underset{\underset{O}{\|}}{C}-R^{12} \qquad \text{Ia}$$

in which $R^{11}$ represents a heterocyclic ring which may be substituted and to which other rings may be fused;

X represents a sulphur atom or a single chemical bond to the nitrogen atom of a heterocyclic ring, $R^{12}$ represents alkyl, aryl, alkoxy, aroxy, cycloalkoxy, a radical X-$R^{11}$ or the radical —[$CH_{2-n}$]—CO—X—$R^{11}$, which substituents may in turn be substituted; and n is an integer.

9. A photographic recording material comprising a support layer, at least one silver halide emulsion layer I, which contains an emulsion mixture of at least one light sensitive silver halide emulsion layer L and a fine-grained, comparatively non-light sensitive silver halide emulsion U, and at least one layer II which either contains no silver halide emulsion or only a comparatively non-sensitive silver halide emulsion, and wherein the combination includes at least one layer II (a) is in water-permeable arrangement in relation to at least one layer I and (b) contains an anti-fogging agent comprising a nitrogen-containing heterocyclic compound which contains a mercapto group and a carboxyl group, or a precursor compound for said anti-fogging agent.

10. A process for the production of photographic color images by the color development of an imagewise exposed color photographic material comprising a photographic recording material comprising a support layer, at least one silver halide emulsion layer I, which contains an emulsion mixture of at least one light sensitive silver halide emulsion layer L containing non-diffusing compounds from which image dyes are producible by development and a fine-grained, comparatively non-light sensitive silver halide emulsion U, and at least one layer II which either contains no silver halide emulsion or only a comparatively non-sensitive siler halide emulsion, and wherein the combination includes at least one layer II (a) is in water-permeable arrangement in relation to at least one layer I and (b) contains an anti-fogging agent or a precursor compound for an anti-fogging agent which process includes a color development step.

* * * * *

UNITED STATES PATENT AND TRADEMARK OFFICE

CERTIFICATE OF CORRECTION

PATENT NO. : 4,369,248

DATED : January 18, 1983

INVENTOR(S) : Erwin Ranz et al

It is certified that error appears in the above-identified patent and that said Letters Patent is hereby corrected as shown below:

Column 19, line 26, delete "improvement comprises"

Signed and Sealed this

*Twenty-first* Day of *June 1983*

[SEAL]

*Attest:*

DONALD J. QUIGG

*Attesting Officer*

*Acting Commissioner of Patents and Trademarks*